United States Patent [19]

Eberle

[11] 4,391,446

[45] Jul. 5, 1983

[54] GOLF BALL DISPENSER

[76] Inventor: John Eberle, 2027 - 28th Ave. SW., Calgary, Alberta, Canada, T2T 1K4

[21] Appl. No.: 176,116

[22] Filed: Aug. 7, 1980

[30] Foreign Application Priority Data

Sep. 25, 1979 [CA] Canada ..... 336457

[51] Int. Cl.[3] ..... A63B 57/00

[52] U.S. Cl. ..... 273/201

[58] Field of Search ..... 273/33, 201, 202; 221/301; 222/22, 517

[56] References Cited

U.S. PATENT DOCUMENTS

| | | | |
|---|---|---|---|
| 493,087 | 3/1893 | Hayden | 221/301 |
| 1,778,952 | 10/1930 | McCullough | 273/201 |
| 1,868,261 | 7/1932 | Spencer | 221/301 |
| 1,948,020 | 2/1934 | Buckingham | 221/301 |
| 2,285,342 | 6/1942 | MacLellan | 273/201 |
| 4,194,648 | 3/1980 | Stanton | 273/201 |

FOREIGN PATENT DOCUMENTS

| | | | |
|---|---|---|---|
| 1073545 | 6/1967 | United Kingdom | 273/201 |

*Primary Examiner*—Richard C. Pinkham

*Assistant Examiner*—S. R. Crow

*Attorney, Agent, or Firm*—Stanley G. Ade

[57] ABSTRACT

A trough is pivotally mounted to a central standard and can rotate through approximately 90° from a rest position to a ball dispensing position above a golf ball tee. The trough, which holds golf balls and may be replenished from a hopper, includes a dispensing head at the outboard end, which is constructed to allow passage of a golf ball therethrough. The head is pivotally attached to the outboard end and can be moved from a ball detent position to a ball release position and vice versa, with the head normally being urged to the detent position by means of a small weight or by gravity. When the head is tipped forwardly to the dispensing position, a detent clears the front ball of the chute or trough which then moves forwardly by gravity so that it is held temporarily between the front of the head and the rear of the aperture through which it will pass. As the head is tipped rearwardly, the detent engages behind the front ball and checks the forward movement of the next ball and at the same time widens the gap between the front of the head and the rear of aperture thus releasing the ball which is deposited upon the tee.

28 Claims, 27 Drawing Figures

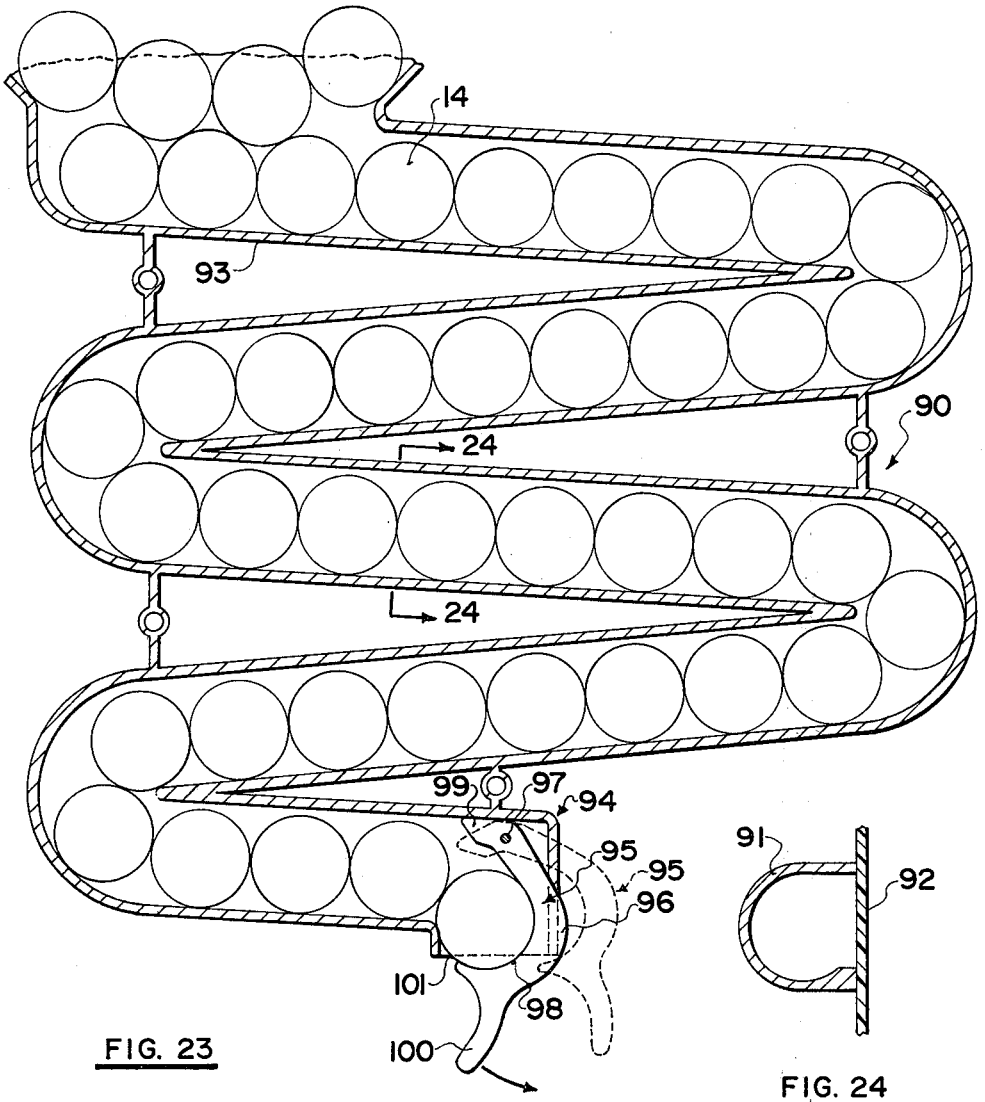
FIG. 23
FIG. 24
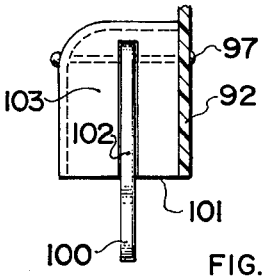
FIG. 25

GOLF BALL DISPENSER

BACKGROUND OF THE INVENTION

This invention relates to new and useful improvements in golf ball dispensers and is particularly designed for use under practice conditions where a plurality of balls is driven from the tee by the player. Conventionally, the player has to bend down and place each ball in position prior to striking same and this is time consuming and tiring.

SUMMARY OF THE INVENTION

The present invention overcomes these disadvantages by providing an automatic ball dispenser which is actuated by the player as and when the needs a ball on the tee.

The device can be operated manually but is desirably pulled into the dispensing position by the head of the golf club engaging around the dispenser tube whereupon a dispensing head is tipped forward slightly by the same head of the golf club and then released thus releasing one ball which drops onto the tee. The golf club is then disconnected or disengaged from the feed tube and the dispenser swings back out of the way so that the ball is ready for play.

In accordance with the invention there is provided a golf ball dispenser for use with a fixed tee comprising in combination a base, a feed tube component mounted upon said base for pivotal movement in a horizontal plane from a ball dispensing position adjacent the tee, to a position clear of the tee and vice versa, said feed tube component sloping downwardly from the base towards the outboard end thereof to feed golf balls by gravity towards said outboard end, and a dispensing head pivotally secured to said outboard end and being movable from a ball detent position to a ball dispensing position and vice versa and means normally urging said head to said ball detent position.

Another advantage of the invention is that full adjustments may be provided so that the positioning of the dispenser head can be controlled, the degree of tilting of the dispenser head can be varied and the vertical relationship of the dispensing tube outboard end relative to the tee can be adjusted.

Another advantage of the invention is to provide a device of the character herewithin described which can either be installed upon an existing tee pad or, alternatively, can be mounted upon a base plate containing both the dispenser and the tee.

Another advantage of the invention is to provide a device which may be provided with a hopper or feed tube to the feed tube dispenser so that the dispensing tube can be replenished automatically as balls are released by the head.

A still further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

FIG. 23 is a vertical cross sectional view of the ball storage component per se.

FIG. 24 is a cross sectional view along the line 24—24 of FIG. 23.

FIG. 25 is an end view of the lower dispensing end of FIG. 23.

In the drawings like characters of reference indicate corresponding parts in the different figures.

DETAILED DESCRIPTION

Figure 2:
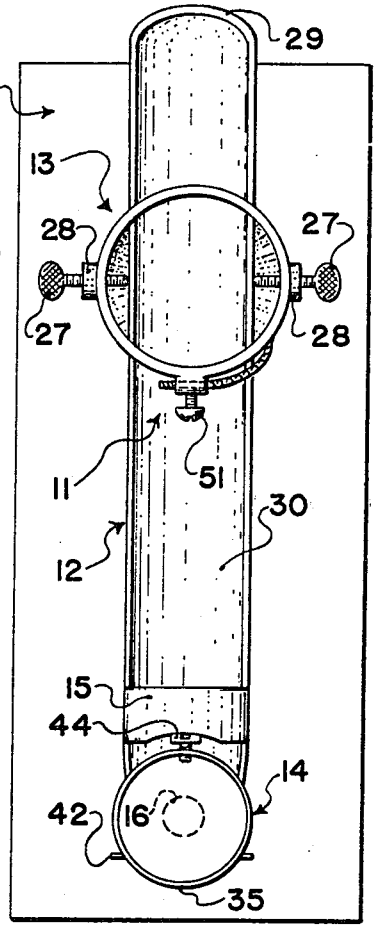
FIG. 2 is a view similar to FIG. 1 but showing the device in the ball dispensing position.
Figure 1:
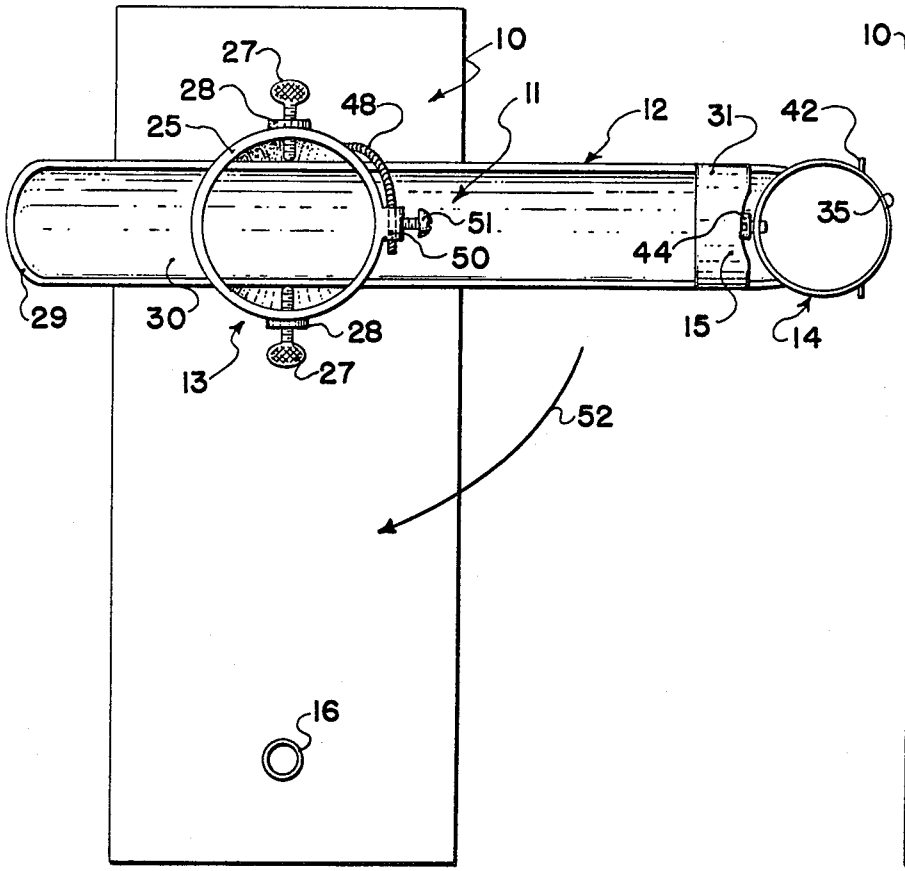
FIG. 1 is a top plan view of the device in the rest or disengaged position.
Figure 3:
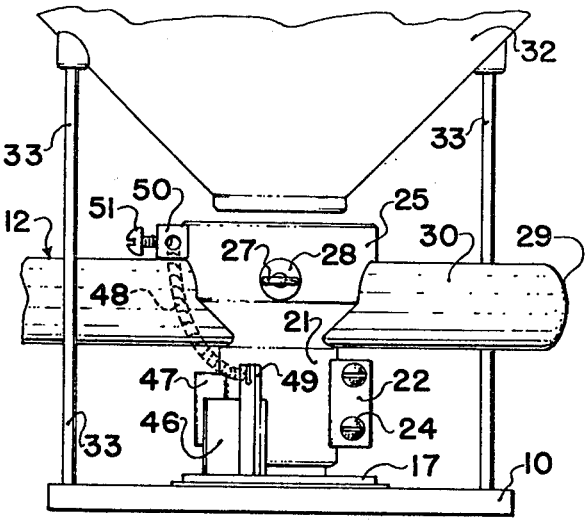
FIG. 3 is a side elevation of the mounting assembly for the feed tube component.
Figure 4:
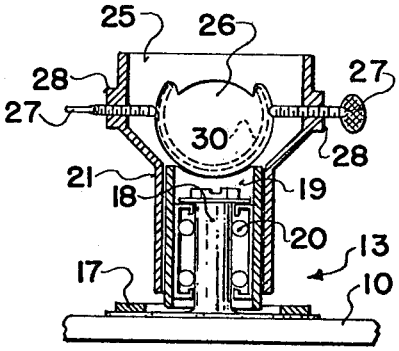
FIG. 4 is a vertical section of FIG. 3.

Proceeding therefore to describe the invention in detail, reference should first be made to FIGS. 1 and 2 which shows a substantially rectangular base plate 10 upon which the dispenser assembly, collectively designated 11, may be mounted. Alternatively, it may be mounted upon a conventional tee pad often provided at driving ranges, practice ranges or the like.

The dispensing assembly comprises a feed tube component collectively designated 12 mounted for partial rotation in a substantially horizontal plane, upon a standard collectively designated 13.

A dispensing head collectively designated 14 is pivotally secured to the outboard end 15 of the feed tube assembly and a tee 16 is provided on the board 10 or on the conventional teeing plate (not illustrated) if used. The tee 16 in the present invention is a short length of flexible tubing extending upwardly from the upper surface of the plate 10 which returns to the perpendicular position after a ball has been struck therefrom.

The standard comprises a base 17 upon which a short vertical tube or post 18 is secured and extends upwardly therefrom.

Figure 6:
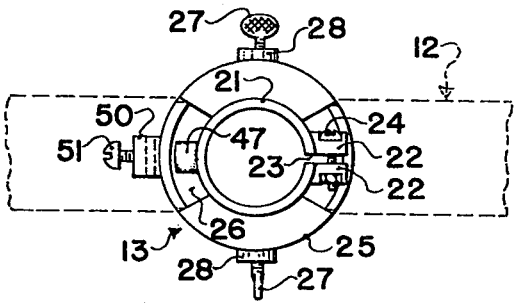
FIG. 6 is an underside view of the assembly of FIG. 3.
Figure 8:
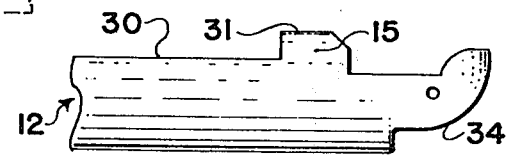
FIG. 8 is a fragmentary side elevation of the outboard end of the feed tube component per se.
Figure 7:
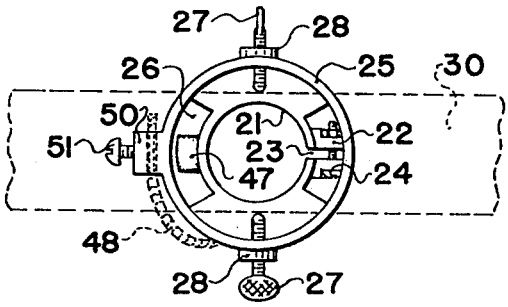
FIG. 7 is a top plan view of the assembly of FIG. 3.

A short tube 19 is mounted upon a roller or ball bearing assembly 20 surrounding the post 18 and is rotatable thereon. A clamp sleeve 21 surrounds the sleeve 19 and is in the form of a split sleeve with clamping flanges or blocks 22 situated on either side of the split or slit 23 (see FIGS. 6 and 7). Nut and bolt assemblies 24 extend through the flanges 22 and may clamp the sleeve around the sleeve 19, it being understood that the clamping sleeve 21 is slightly resilient.

This permits vertical adjustment of the clamp sleeve 21 relative to the post 18 and also permits rotational adjustment of the clamp sleeve.

A cup is provided upon the upper end of the clamp sleeve 21 and is preferably built integrally therewith, said cup being identified by reference character 25. This cup is apertured diametrically as indicated by reference 26 and the feed tube component 12 slidably engages through these apertures 26 and across the cup 25 and may be clamped in the desired fore and aft position by means of clamp screws 27 passing through screw threaded blocks 28 secured to the side walls of the cup 25. The inner ends of these clamp screws engage the sides of the feed tube component and hold it is position relative to the cup 25. The feed tube component 12 is preferably in the form of an open upper sided trough having a closed rear end 29, the open top 30 and an outboard end 15. However it will of course be appreciated that it can be a closed tube with the exception of a portion in the upper side thereof required to load golf balls into the trough for dispensing at the outboard end.

Means may be provided to automatically feed balls to the trough or feed tube component 12 and a hopper 32 is shown situated above the upper side of the cup 25 into which balls may be placed in bulk and will then feed downwardly into the trough as the space becomes available. This hopper may be supported from the base 10 by means of support members 33 or any other convenient means.

Alternatively, other means such as a feed tube (not illustrated) may be provided to feed balls to the trough preferably through the upper side of cup 25 but if necessary, to the rear portion of the trough 12 extending rearwardly of the cup 25.

Figure 12:
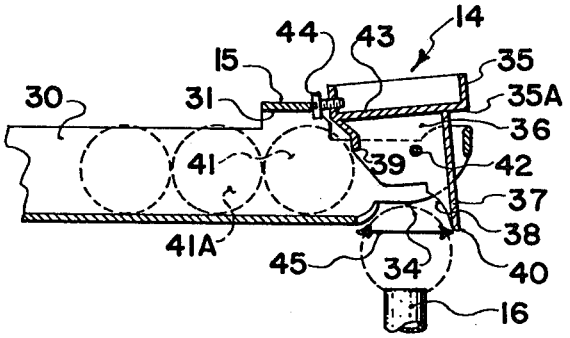
FIG. 12 is a view of the outboard end and the dispensing head in the detent position, sectioned in part to show the interior thereof.

When in position within the cup 25, the trough slopes slightly downwardly towards the outboard end 15 so that golf balls therein will roll towards this outboard end and a bridge portion 31 is provided at the outboard end 15 as illustrated in FIGS. 1 and 12.

A dispensing aperture 34 is provided in the base of the outboard end 15 through which golf balls may be dispensed one at a time and the dispensing head 14 acts as a detent and release mechanism for this purpose.

The head consists of the upper portion 35, a surrounding wall portion 36 and a front wall 37. The side walls 36 are cut away as indicated by reference character 38 to define the rear wall portion 39 situated above the lower side 40 of the front wall and when in the position shown in FIG. 12, this rear wall engages the foremost golf ball 41 and prevents it from moving towards the dispensing aperture 34. The dispensing head is pivoted to the sides of the front end or outboard end of the trough by means of transverse pivot pin 42 and a small weight 43 within the upper portion 35 is provided normally to urge the head 14 in the rearward or ball detent position illustrated in FIG. 12. To this end it will be noted that the pin 42 engages the head forwardly of the vertical axis thereof and hence forwardly of the center of gravity.

A small adjusting screw 44 engages the rear of the upper portion 35 and may be screwed inwardly or outwardly. The head of this screw engages the front of the bridge portion 31 so that by adjusting the screw 44, the degree of tilt of the dispensing head may be controlled.

Figure 13:
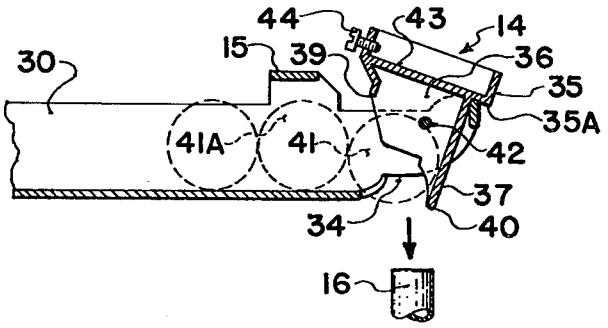
FIG. 13 is a view similar to FIG. 12 but showing the head in the ball dispensing position.

It will be noted that when in the ball detent position shown in FIG. 12, the front wall 40 provides sufficient space through the aperture 34 as indicated by arrow 45 to permit a golf ball to pass therethrough. However when the head is tipped forwardly so that the underside 35A of the upper portion engages the upper rim of the outboard end of the tube, the head takes up the position shown in FIG. 13. This raises the detent 39 clear of the ball and allows it to roll to the position shown in phantom in FIG. 13 but it will be noted that the distance 45 has narrowed considerably due to the fact that the front wall 40 has moved forwards the rear of the aperture 34 so that golf ball although moving downwardly into the dispensing aperture, cannot clear this aperture. This prevents further balls from dispensing at this point. The dispensing head is then moved back to the original position shown in FIG. 12 so that the detent 39 engages between the front ball 41 and the next succeeding ball 41A thus preventing this next succeeding ball from moving into the dispensing aperture. At the same time the dispensing aperture is widen to its original distance as indicated by arrows 45 thus allowing the ball to drop downwardly upon the tee tube 16 which is situated immediately therebelow when the dispenser is in the position shown in FIG. 2.

Figure 5:
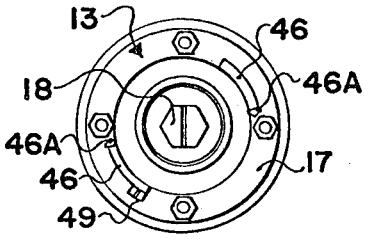
FIG. 5 is a top plan view of FIG. 3 with the support assembly removed for clarity.
Figure 9:
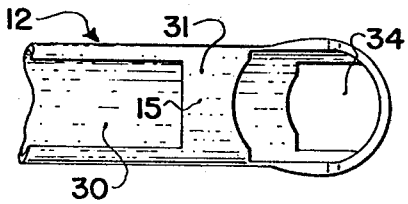
FIG. 9 is a top plan view of FIG. 8.
Figure 10:
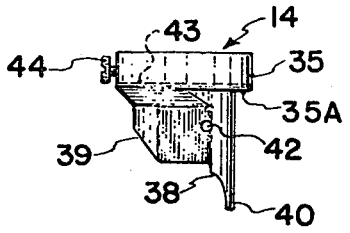
FIG. 10 is a side elevation of the dispensing head per se.
Figure 11:
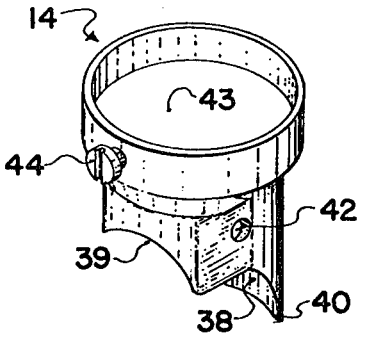
FIG. 11 is an isometric view of FIG. 10.

Reference to FIGS. 5 and 9 will show stops 46 extending upwardly from the base which are engaged by the flanges 22 of the clamp tube and a projection 47 extending from the clamp tube diametrically opposite thereto. This controls and limits the position of the feed tube component 12 both in the rest position shown in FIG. 1 and the dispensing position shown in FIG. 2 and resilient pads 46A are provided to act as shock absorbers in both positions.

Means are provided to normally urge the feed tube component 12 to the rear position illustrated in FIG. 1, said means, in this embodiment, taking the form of a coiled tension spring 48 having one end secured to an anchor post 49 adjacent one of the stops 46 (see FIG. 5) and coiling around the standard and being detachably secured by the other end within a sleeve 50 on the front of the cup 25. The coiled spring is positioned within the sleeve in order to provide the correct tension and clamped in position by means of screw or bolt 51 (see FIG. 1). As mentioned previously, the device is fully adjustable as to position, both fore and aft and vertically, radially and the tension of the spring 48. Furthermore the screw 44 adjusts the fore and aft tipping action of the dispensing head 14.

It will also be appreciated that by removing the feed tube component from the standard and moving it through 180° with reference to FIG. 1, the device can be adapted for use by a lefthanded golfer.

In operation, balls are fed to the hopper 32, whence they pass by gravity to the feed tube component 12 and roll downwardly towards the outboard end 31 with the foremost ball 41 being held by the detent 39 in the position shown in FIG. 12.

When the player desires a ball to be placed upon the tee 16, the feed tube component is moved through approximately 90° in direction of arrow 52 until the stop 46 limits the swinging movement whereupon it is situated above the tee 16. The dispensing head is rocked first forwardly to release the front ball 41 and then rearwardly to separate ball 41 from ball 41A and to release ball 41 downwardly upon the tee 16 whereupon the feed tube component is released so that spring 48 returns it to the original position shown in FIG. 1.

In practice, it is convenient for the player to hook the head of the golf club over the feed tube component 12 adjacent the outboard end thereof and to draw it towards him to the position of FIG. 2 whereupon further movement of the golf club head will tilt the dispensing head 14 and rearward movement of the golf club head will release the ball upon the tee whereupon he may remove the golf club from the feed tube component which will automatically swing back out of the way to take up the position shown in FIG. 1.

Although a spring has been shown to act as the return means for the feed tube component, nevertheless it will be appreciated that other methods of return can be used. For example, a pulley and weight (not illustrated) can be provided with the feed tube component being pulled forwardly and lifting the weight by means of a cable and pulley, the weight then returning the feed tube component to the clear position when released.

Figure 16:
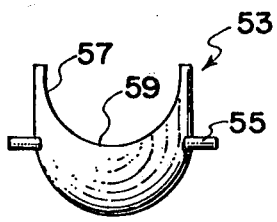
FIG. 16 is a top plan view of the head per se.
Figure 17:
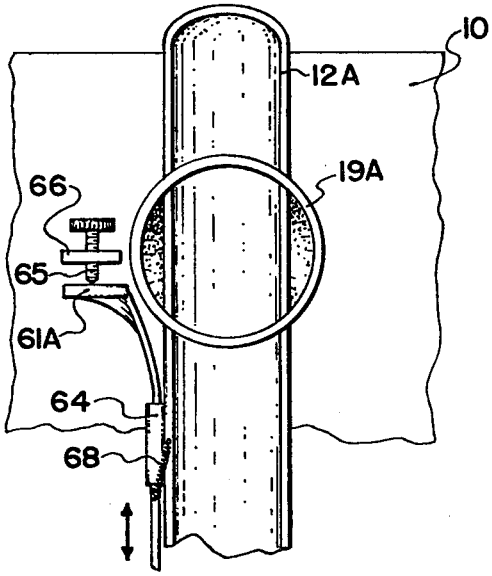
FIG. 17 is a fragmentary plan view showing the mounting of the dispensing tube in the further embodiment with the automatic head actuating mechanism.

FIGS. 14 through 18 show a further embodiment of the device and dealing first with FIG. 17, this embodiment shows the feed tube 12A formed integrally with the sleeve 19A and mounted for rotation upon the base 10 in a manner similar to that hereinbefore described. This embodiment is otherwise similar in mounting and operation to the embodiment first described insofar as the feed tube and mounting post assembly is concerned.

In this embodiment, the dispensing head collectively designated 14A is provided upon the distal end of the feed tube or trough 12A and includes the dispensing aperture 34 within the underside of the distal end portion which may be enclosed by upper plate portion 31A similar to the bridge portion 31. Alternatively it may be left open as desired.

The detent and release action in this embodiment consists of a semi-spherical component collectively designated 53 pivoted within the semi-spherical end portion 54 of the distal end of the feed trough by means of transversely extending pins 55 extending upon each side of the component 53 and engaging the side walls 56 of the feed tube or trough. The rear portion 57 of the semi-spherical component 53 is cut away in an arcuate curve 58 as clearly shown in FIG. 16.

Figure 14:
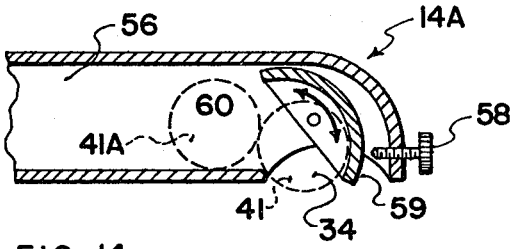
FIG. 14 is a partially sectioned fragmentary side elevation of the distal end of the dispensing tube showing a further embodiment of the dispensing head in the ball detent position.
Figure 15:
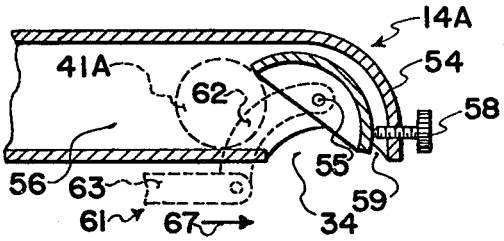
FIG. 15 is a view similar to FIG. 14 but showing the head in the ball dispensing position.
Figure 18:
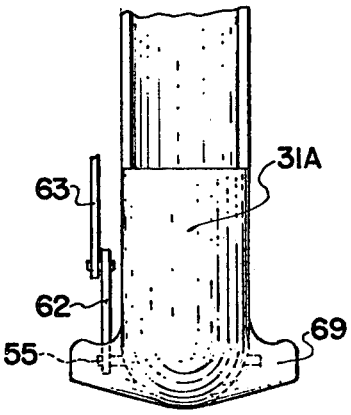
FIG. 18 is a top plan view of FIG. 15.

This component is situated as shown in FIGS. 14 and 15 and the position thereof may be adjusted by means of an adjustment screw 58 engaging through the end wall of the tube or trough 14A as shown. When golf balls are in the trough and are fed by gravity towards the distal end thereof, the first ball 41 takes up the position shown in phantom in FIG. 14 with the second ball 41A immediately therebehind.

The lower edge 59 of the component 53 (the position of which is controlled by screw 58) restricts the aperture 34 and prevents the ball 41 from falling therefrom. This position, illustrated in FIG. 14, is the ball detent position.

However, if the component 53 is moved slightly in the direction of arrow 60, around pivots 55, then the lower edge 59 moves upwardly slightly and derestricts the aperture 34 thereby permitting the ball 41 to fall downwardly through the aperture. At the same time the rear arcuate edge 58 of the component 53 engages between the balls 41 and 41A and prevents ball 41A from passing to the distal end of the feed trough thereby preventing this ball 41A from being dispensed. When in this position, component 53 is in the ball release position or ball dispensing position.

However, as soon as the component 53 is returned to the position shown in FIG. 14, ball 41A moves downwardly and takes up the position of ball 41 but of course is prevented from dispensing due to the detent action of component 53. In the previous embodiment, this escapement action is controlled by the player but in this embodiment, it is controlled automatically. A lever component collectively designated 61 is provided and consists of an arcuately curved or crank-type portion 62 secured to pivot pin 55 by one end thereof and to an actuating lever portion 63 by the other end thereof. This actuating portion extends rearwardly parallel to the trough 12A, and may be guided by guides 64 secured to the side of the trough. Adjacent the pedestal or sleeve 19A, an enlarged portion 61A may be provided which, when the feed trough is in the ball dispensing position above tee 16, engages the end of an adjustment screw 65 secured to the base through bracket 66. As the trough swings to the dispensing position, the stop or screw 65 moves the actuating lever portion 63 in the direction of arrow 67 thus rotating the component 53 from the ball detent position to the ball release position, it being understood that a very small movement of component 53 is required.

Once the ball has been dispensed, the trough component is released and it is returned to the position clear of the tee as in the previous embodiment. As soon as portion 61A is cleared from stop 65, means such as a small tension spring 68 extending between lever portion 63 and the trough 12A, returns the lever component to the original position, namely, the ball detent position.

Offstanding projections 69 may extend from each side of the distal end 14A of the trough 12A and may be engaged by the head of the golf club to pull the dispenser to the ball dispensing position against pressure of spring 48 as hereinbefore described.

The preferred embodiment is shown in FIGS. 19–22.

The dispenser collectively designated 70 may be mounted upon a base 10 or upon a fixed support similar to the other embodiments. It includes a feed or dispenser tube collectively designated 71 which may be in the form of a trough or tube mounted for rotation in a horizontal plane upon a standard collectively designated 72 secured to and extending upwardly from adjacent the rear end of the base 10. The standard preferably includes a tubular portion 73 formed integrally with and depending downwardly from the tube 71 towards the upper end thereof and being secured to a bearing block 74 by means of screws or bolts 75. The bearing block 74 engages a support bolt 76 thus enabling the tube to swing through approximately 90° in a manner similar to that hereinbefore described and stop means (not illustrated) may be provided to limit this movement.

Figure 20:
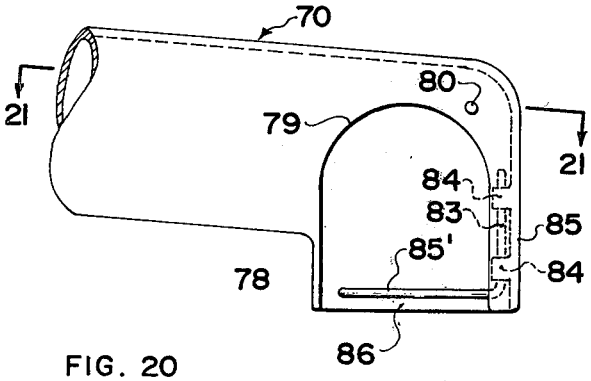
FIG. 20 is a fragmentary side elevational view of the distal end of the dispensing tube of FIG. 10.

It will be observed that the tube or trough 71 slopes downwardly from adjacent the rear or intake end 77 to the outlet or dispensing end 78 with the lower end having a downturned dispensing end cut away at least on one side as indicated by reference character 79 in FIG. 20.

A dispensing head collectively designated 79 is provided within the dispensing end similar in construction to component 53 illustrated in FIG. 16. This is pivoted within the discharge end of the tube or trough 70 by means of a cross pin 80 and is semi-spherical in configuration with the rear portion 81 being cut away in an arcuate curve 82 similar to the previously mentioned embodiment.

Figure 19:
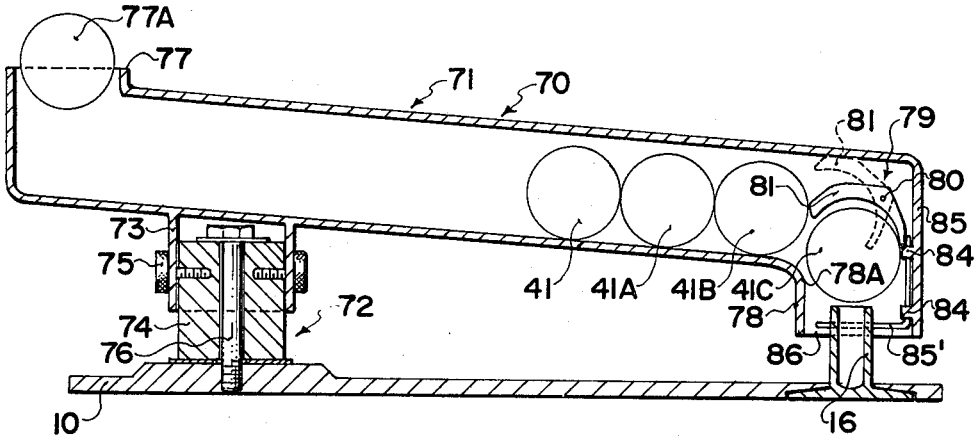
FIG. 19 is a fragmentary cross sectional side elevational view of the preferred embodiment of the device.

It is pivotal between the ball detent position shown in solid line in FIG. 19 to the ball dispensing position shown in phantom and operates in a similar manner to component 53. The pivot pins 80 are situated forwardly of the center of gravity of the component 79 so that it normally returns to the ball detent position illustrated in FIG. 19.

Figure 22:
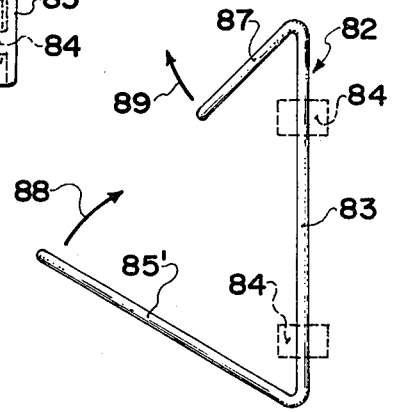
FIG. 22 is an isometric view of the dispensing head actuator of the preferred embodiment.
Figure 21:
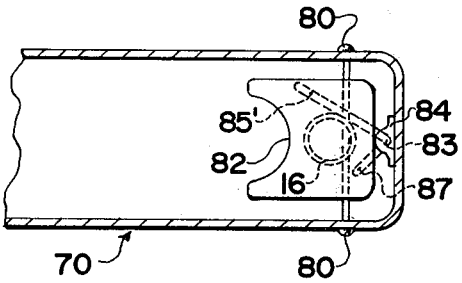
FIG. 21 is a cross sectional plan view of FIG. 20 along the line 21—21 of FIG. 20.
Figure 26:
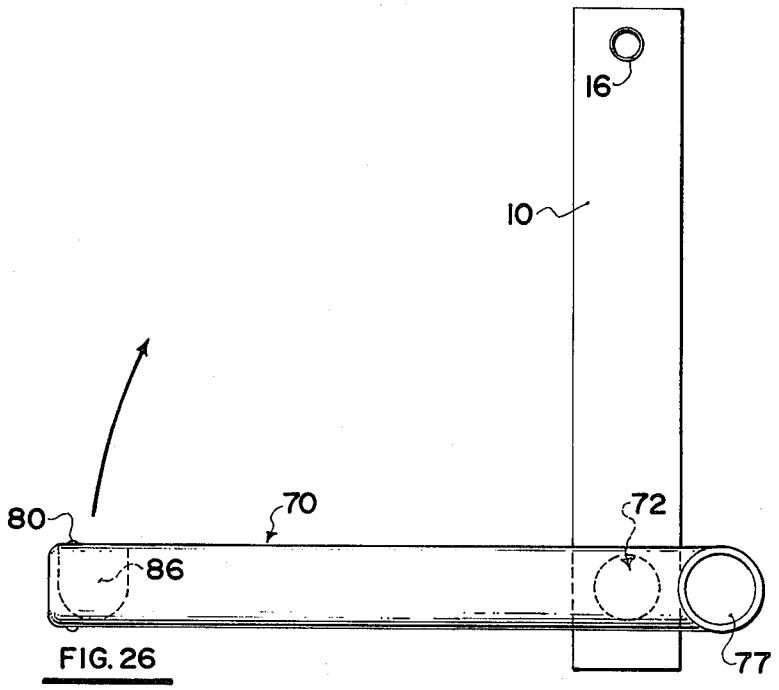
FIG. 26 is a partially schematic plan view of FIG. 19 showing the device in the position clear of the tee.
Figure 27:
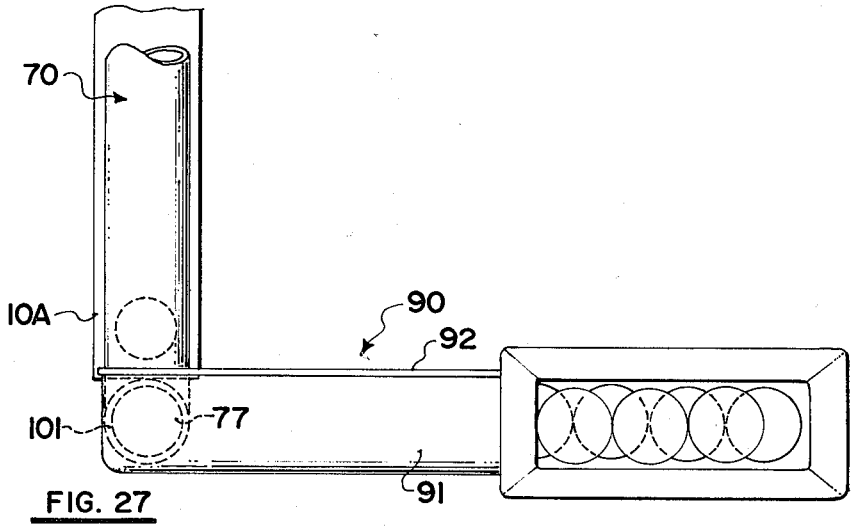
FIG. 27 is a partially schematic top plan view of the ball dispensing component together with the rear end of the dispenser shown in the tee engaging position.

Means are provided to actuate this dispensing head 79, said means taking the form of a multi angulated pin component collectively designated 82 and illustrated in FIG. 22. It includes a vertical stem 83 supported for rotation within bearings 84 formed on the front wall 85A of the dispensing end 78 and includes a tee striking portion 85 extending substantially at right angles from the lower end of the vertical portion 83 and spanning the discharge end 86 of the dispensing end as clearly shown in FIG. 19.

A dispensing head engaging portion 87 extends at right angles from the upper end of the vertical portion 83 and this portion is substantially at right angles to the tee striking portion 85. It engages the lower side of the dispensing head 79 as clearly shown in FIG. 19.

In operation of this portion of the device, golf balls 41 are stored within the tube or trough 70 with the balls specifically designated 41A being held by the rear portion 81 of the dispenser head which is in the ball detent position under normal circumstances.

The dispenser is swung from the position clear of the tee, to the dispensing position by engaging the head of a golf club around the end of the tube and drawing it through approximately 90°. As it reaches the dispensing position adjacent the tee 16, the tee striking portion 85 is engaged by the tee and is moved in the direction of arrow 88 (see FIG. 22) thus moving the portion 87, in the direction of arrow 89. This rocks the dispensing head 79 to the position shown in phantom thus releasing ball 41A to the position shown in phantom in FIG. 19 engaging the upper end of the tee 16. With the device in the position shown in FIG. 19, the next ball is prevented from moving downwardly by the ball on the tee and as the club head slips off the end of the dispenser, it commences to return to the position clear of the tee thus releasing the portion 85 of the pin 82 and allowing the dispensing head 79 to return to the position shown in full line thus stopping the next ball from dispensing. It should be appreciated that the action is instantaneous and as soon as the tee is struck by the portion 85, the ball is dispensed and the next ball cannot move downwardly.

The return of the feed tube or trough 70 can be by gravity, by slightly sloping the standard 76 or can include a spring similar to the spring 48 described in the previous embodiments.

A further feature of the present invention, which may be incorporated with either the present embodiment or the previous embodiments, is the provision of a ball storage component collectively designated 90 and shown in FIGS. 23–27.

It consists of a U-shaped cross sectioned trough 91 situated on its side and preferably formed by injection moulding in the serpentine configuration illustrated in FIG. 23 and mounted against a guard wall or vertical plate 92 and secured by adhesive or other suitable means in a manner similar to that shown in FIG. 24.

The upper run specifically designated 93 is preferably an open trough so that balls may be fed manually therein as illustrated or, a funnel (not illustrated) may be engaged for the automatic feeding of balls to this upper run. The balls run by gravity down the serpentine track to the dispensing end specifically designated 94 which is provided with a ball storage component dispensing head collectively designated 95. This is a trigger plate 96 pivoted by transverse pin 97 to the sides of the lowermost run and the vertical wall 92 as shown in FIG. 25. It includes the ball receiving jaw portion 98, the detent upper end 99, and the lower actuating end 100 which depends downwardly from the ball discharge aperture 101 formed at the end of the lower run of the trough 91.

It will be noted that this plate 95 engages through a vertical slot 102 formed in the end wall 103 and that the mounting pin 97 engages the dispensing head adjacent the upper end 99 so that it normally rests in the position shown in solid line in FIG. 23 due to gravity. The ball storage component is situated adjacent the rear end 10A of the base 10 and substantially at right angles thereto with the portion 100 of the dispensing head 95 being situated so that it is struck by the rear end 77 of the feed tube or trough 71 when it returns to the position clear of the tee illustrated in FIGS. 26 and 27. The return of this component 70, to the position clear of the tee, moves the dispensing head 95 to the position shown in phantom in FIG. 23 thus permitting one ball to be released from the aperture 101 and it will be observed that the detent end 99 will prevent the next ball from moving forwardly as long as the dispensing head is in the position shown in phantom in FIG. 23.

This means that each time a ball is dispensed from the end 86 of the feed tube or trough 70, and this feed tube or trough is returned to the position clear of the tee, a further ball is dispensed from the ball storage component entering the trough at the ball intake 77A at the rear end 77 and on the upper side thereof.

In operation, it is normal to move the component 70 away from the position clear of the tee, with the head of the golf club or manually, two or three times to feed several balls from the ball storage component into the feed tube or trough 70, it being understood that it is not necessary to fill the feed trough although it is shown filled in FIG. 19.

With two or three balls in the trough, each time one is dispensed therefrom, a replacement is transferred from the ball storage component which can be adapted to hold as many balls as necessary, within design parameters.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A golf ball dispenser for use with a fixed tee comprising in combination a base, a feed tube component mounted upon said base for pivotal movement in a horizontal plane from a ball dispensing position adjacent the tee, to a position clear of the tee and vice versa, said feed tube component sloping downwardly towards the outboard end thereof to feed golf balls by gravity towards said outboard end, a dispensing head pivotally secured to said outboard end and being movable from a ball detent position to a ball dispensing position and vice versa, means normally urging said head to said ball detent position, said outboard end of said feed tube component being apertured in the base thereof to provide a ball dispensing aperture, said dispensing head being pivotally supported for fore and aft tipping movement, within said feed tube component adjacent said ball dispensing aperture, said head including a front wall and rear wall, said rear wall acting as a ball detent when in said ball detent position and preventing a ball from passing from said feed tube component to said aperture, said detent releasing the front ball in said feed tube component to a position in said aperture, when said head is moved to said ball dispensing position, said front wall holding said ball in said ball dispensing position, said detent engaging between said front ball and the ball immediately therebehind and thereby releasing said front ball through said aperture, when said head is moved back to the ball detent position, means to activate said head including means spanning said aperture and engaging the associated tee when said dispenser is moved to the dispensing position, said last mentioned means including a tee striking portion pivoted for movement to said front wall of the feed tube and extending into said aperture, and a dispensing head engaging portion connected to said tee striking portion, for moving said dispensing head to the ball dispensing position when said tee striking portion engages said tee.

2. The dispenser according to claim 1 which includes means normally urging said feed tube component to the position clear of the tee.

3. The dispenser according to claim 2 which includes means mounting said feed tube component for said pivotal movement in a substantially horizontal plane, said means comprising a standard secured to said base and extending upwardly therefrom, a feed tube component support assembly journalled for rotation upon said standard, said feed tube component slidably engaging said support assembly for fore and aft movement therethrough and means to detachably clamp said feed tube component in said support assembly in the desired position relative to said tee.

4. The dispenser according to claim 3 in which said support assembly includes a sleeve, bearings mounting said sleeve for rotation upon said standard, a clamp sleeve surrounding said first mentioned sleeve and being adjustable radially and vertically relative to said first mentioned sleeve and a feed tube component holding cup mounted upon said clamp sleeve, said feed tube component holding cup being apertured to slidably receive said feed tube component and clamp means to detachably clamp said feed tube component to said holding cup.

5. The dispenser according to claim 4 which includes means on said base to limit the swinging movement of said feed tube component in both said positions.

6. The dispenser according to claim 2 which includes means on said base to limit the swinging movement of said feed tube component in both said positions.

7. The dispenser according to claim 3 which includes means on said base to limit the swinging movement of said feed tube component in both said positions.

8. The dispenser according to claim 1 which includes means mounting said feed tube component for said pivotal movement in a substantially horizontal plane, said means comprising a standard secured to said base and extending upwardly therefrom, a feed tube component support assembly journalled for rotation upon said standard, said feed tube component slidably engaging said support assembly for fore and aft movement therethrough and means to detachably clamp said feed tube component in said support assembly in the desired position relative to said tee.

9. The dispenser according to claim 8 in which said support assembly includes a sleeve, bearings mounting said sleeve for rotation upon said standard, a clamp sleeve surrounding said first mentioned sleeve and being adjustable radially and vertically relative to said first mentioned sleeve and a feed tube component holding cup mounted upon said clamp sleeve, said feed tube component holding cup being apertured to slidably receive said feed tube component and clamp means to detachably clamp said feed tube component to said holding cup.

10. The dispenser according to claim 9 which includes means on said base to limit the swinging movement of said feed tube component in both said positions.

11. The dispenser according to claim 8 which includes a ball storage component mounted adjacent the rear end of said feed tube, said ball storage component including a storage trough having an inlet end and an outlet end and sloping downwardly from said inlet end to said outlet end, a ball dispensing aperture at said outlet end and a ball storage component dispensing head mounting adjacent said outlet end and being movable from a ball detent position to a ball dispensing position and vice versa, means extending from said ball storage component dispensing head engageable by the rear end of said feed trough when in the position clear of the tee, to move said ball storage component dispensing head from the ball detent position to the ball dispensing position, and means to return said ball storage component dispensing head to the ball detent position when said feed tube is moved away from said position clear of the tee.

12. The dispenser according to claim 11 in which said outlet end of said storage trough is apertured in the base thereof to provide a ball dispensing aperture, the ball storage component dispensing head being pivotally supported for fore and aft tipping movement, to said storage trough adjacent said ball dispensing aperture, said ball storage component dispensing head including a front wall and a rear wall, said rear wall acting as a ball detent when in said ball detent position and preventing a ball from passing from said storage trough to said aperture, said detent releasing the front ball in said storage trough when said head is moved to said ball dispensing position, to a position in said aperture, said front wall holding said ball in said ball dispensing position in combination with the rear wall of said aperture, said detent engaging between said front ball and the ball immediately therebehind in said storage trough and releasing said front ball through said aperture in said storage trough, when said head is moved back to the ball detent position.

13. The dispenser according to claim 12 in which said means normally urging said ball storage component dispensing head to the ball detent position includes a mounting pin for said pivotal securement of said head to the outboard end of said storage trough, said mounting pin engaging said head forwardly of the centre of gravity thereof whereby the weight of said head automatically returns it to the ball detent position.

14. The dispenser according to claim 8 in which said outlet end of said storage trough is apertured in the base thereof to provide a ball dispensing aperture, the ball storage component dispensing head being pivotally supported for fore and aft tipping movement, to said storage trough adjacent said ball dispensing aperture, said ball storage component dispensing head including a front wall and a rear wall, said rear wall acting as a ball detent when in said ball detent position and preventing a ball from passing from said storage trough to said aperture, said detent releasing the front ball in said storage trough when said head is moved to said ball dispensing position, to a position in said aperture, said front wall holding said ball in said ball dispensing position in combination with the rear wall of said aperture, said detent engaging between said front ball and the ball immediately therebehind in said storage trough and releasing said front ball through said aperture in said storage trough, when said head is moved back to the ball detent position.

15. The dispenser according to claim 8 which includes means on said base to limit the swinging movement of said feed tube component in both said positions.

16. The dispenser according to claim 1 which includes means on said base to limit the swinging movement of said feed tube component in both said positions.

17. The dispenser according to claim 1 which includes a ball storage component mounted adjacent the rear end of said feed tube, said ball storage component including a storage trough having an inlet end and an outlet end and sloping downwardly from said inlet end to said outlet end, a ball dispensing aperture at said outlet end and a ball storage component dispensing head mounting adjacent said outlet end and being movable from a ball detent position to a ball dispensing position and vice versa, means extending from said ball storage component dispensing head engageable by the rear end of said feed trough when in the position clear of the tee, to move said ball storage component dispensing head from the ball detent position to the ball dispensing position, and means to return said ball storage component dispensing head to the ball detent position when said feed tube is moved away from said position clear of the tee.

18. The dispenser according to claim 17 in which said outlet end of said storage trough is apertured in the base thereof to provide a ball dispensing aperture, the ball storage component dispensing head being pivotally supported for fore and aft tipping movement, to said storage trough adjacent said ball dispensing aperture, said ball storage component dispensing head including a front wall and a rear wall, said rear wall acting as a ball detent when in said ball detent position and preventing a ball from passing from said storage trough to said aperture, said detent releasing the front ball in said storage trough when said head is moved to said ball dispensing position, to a position in said aperture, said front wall holding said ball in said ball dispensing position in combination with the rear wall of said aperture, said detent engaging between said front ball and the ball immediately therebehind in said storage trough and releasing said front ball through said aperture in said storage trough, when said head is moved back to the ball detent position.

19. The dispenser according to claim 1 in which said outlet end of said storage trough is apertured in the base thereof to provide a ball dispensing aperture, the ball storage component dispensing head being pivotally supported for fore and aft tipping movement, to said storage trough adjacent said ball dispensing aperture, said ball storage component dispensing head including a front wall and a rear wall, said rear wall acting as a ball detent when in said ball detent position and preventing a ball from passing from said storage trough to said aperture, said detent releasing the front ball in said storage trough when said head is moved to said ball dispensing position, to a position in said aperture, said front wall holding said ball in said ball dispensing position in combination with the rear wall of said aperture, said detent engaging between said front ball and the ball immediately therebehind in said storage trough and releasing said front ball through said aperture in said storage trough, when said head is moved back to the ball detent position.

20. The dispenser according to claims 1, 2 or 8 in which said means normally urging said head to the ball detent position includes a mounting pin for said pivotal securement of said head to said outboard end of said feed tube component, said mounting pin engaging said head forwardly of the center of gravity of said head whereby the weight of said head automatically returns it to the ball detent position, and means to adjust the ball detent position of said head.

21. The dispenser according to claims 3, 9 or 4 in which said means normally urging said head to the ball detent position includes a mounting pin for said pivotal securement of said head to said outboard end of said feed tube component, said mounting pin engaging said head forwardly of the center of gravity of said head whereby the weight of said head automatically returns it to the ball detent position, and means to adjust the ball detent position of said head.

22. The dispenser according to claims 16, 6 or 15 in which said means normally urging said head to the ball detent position includes a mounting pin for said pivotal securement of said head to said outboard end of said feed tube component, said mounting pin engaging said head forwardly of the center of gravity of said head whereby the weight of said head automatically returns it to the ball detent position, and means to adjust the ball detent position of said head.

23. The dispenser according to claims 7, 10 or 5 in which said means normally urging said head to the ball detent position includes a mounting pin for said pivotal securement of said head to said outboard end of said feed tube component, said mounting pin engaging said head forwardly of the center of gravity of said head whereby the weight of said head automatically returns it to the ball detent position, and means to adjust the ball detent position of said head.

24. The dispenser according to claims 1, 2 or 8 in which said means normally urging said head to the ball detent position includes a mounting pin for said pivotal securement of said head to said outboard end of said feed tube component, and a lever component operatively connected to said head for moving said head from said ball detent position to said ball dispensing position and vice versa, spring means normally mounting said lever in the position maintaining said head in said ball detent position and means on said dispenser operatively engaging said lever component for moving said lever component to a position whereby said lever component moves said head to said ball dispensing position when said feed tube component is in the ball dispensing position.

25. The dispenser according to claims 3, 9 or 4 in which said means normally urging said head to the ball detent position includes a mounting pin for said pivotal securement of said head to said outboard end of said feed tube component and a lever component operatively connected to said head for moving said head from said ball detent position to said ball dispensing position and vice versa, spring means normally mounting said lever in the position maintaining said head in said ball detent position and means on said dispenser operatively engaging said lever component for moving said lever component to a position whereby said lever component moves said head to said ball dispensing position when said feed tube component is in the ball dispensing position.

26. The dispenser according to claims 10, 6 or 15 in which said means normally urging said head to the ball detent position includes a mounting pin for said pivotal securement of said head to said outboard end of said feed tube component and a lever component operatively connected to said head for moving said head from said ball detent position to said ball dispensing position and vice versa, spring means normally mounting said lever in the position maintaining said head in said ball detent position and means on said dispenser operatively engaging said lever component for moving said lever component to a position whereby said lever component moves said head to said ball dispensing position when said feed tube component is in the ball dispensing position.

27. The dispenser according to claims 19, 14 or 18 in which said means normally urging said ball storage component dispensing head to the ball detent position includes a mounting pin for said pivotal securement of said head to the outboard end of said storage trough, said mounting pin engaging said head forwardly of the centre of gravity thereof whereby the weight of said head automatically returns it to the ball detent position.

28. The dispenser according to claims 7, 11 or 12 in which said means normally urging said head to the ball detent position includes a mounting pin for said pivotal securement of said head to said outboard end of said feed tube component and a lever component operatively connected to said head for moving said head from said ball detent position to said ball dispensing position and vice versa, spring means normally mounting said lever in the position maintaining said head in said ball detent position and means on said dispenser operatively engaging said lever component for moving said lever component to a position whereby said lever component moves said head to said ball dispensing position when said feed tube component is in the ball dispensing position.

* * * * *